US007364457B2

(12) United States Patent
Mehki

(10) Patent No.: US 7,364,457 B2
(45) Date of Patent: Apr. 29, 2008

(54) BATTERY HOOKUP ASSEMBLY

(76) Inventor: Larry Mehki, 5023 Brentwood Dr., Monroe, MI (US) 48161

( * ) Notice: Subject to any disclaimer, the term of this patent is extended or adjusted under 35 U.S.C. 154(b) by 0 days.

(21) Appl. No.: 11/004,010

(22) Filed: Dec. 2, 2004

(65) Prior Publication Data

US 2005/0118862 A1 Jun. 2, 2005

Related U.S. Application Data

(60) Provisional application No. 60/526,402, filed on Dec. 2, 2003.

(51) Int. Cl.
*H01R 11/00* (2006.01)

(52) U.S. Cl. ..... 439/504; 439/34

(58) Field of Classification Search ..... 439/34, 439/503, 504, 709, 754, 755, 759, 957
See application file for complete search history.

(56) References Cited

U.S. PATENT DOCUMENTS 4,261,634 A * 4/1981 Robinson ..... 439/668

* cited by examiner

*Primary Examiner*—Khiem Nguyen
(74) *Attorney, Agent, or Firm*—Brooks Kushman P.C.

(57) ABSTRACT

A battery hookup assembly is provided for transmitting current from an auxiliary power source to a battery of a motor vehicle. The battery hookup assembly includes a housing adapted to be fixedly mounted to a portion of the motor vehicle. First and second terminals are fixedly secured to the housing for selectively receiving current from the auxiliary power source. At least one cable extends between the first and second terminals and the battery for transmitting current received by the first and second terminals to the battery.

18 Claims, 7 Drawing Sheets

BATTERY HOOKUP ASSEMBLY

CROSS REFERENCE TO RELATED APPLICATION

This application claims priority to and all the benefits of U.S. Provisional Application Ser. No. 60/526,402, filed on Dec. 2, 2003 and entitled "Battery Hookup Assembly".

BACKGROUND OF THE INVENTION

1. Field of the Invention

The invention relates to an electrical storage battery for a motor vehicle. More particularly, this invention relates to a readily accessible battery hookup assembly for transmitting current from an auxiliary power source to an electrical storage battery of a motor vehicle.

2. Description of Related Art

An electrical storage battery for a motor vehicle provides current to a starter motor and ignition system, supplies additional current when the demand is higher than an alternator can supply, and stabilizes voltage in the electrical system of the motor vehicle. There are, however, instances in which the battery goes dead, i.e., the battery is weak or discharged, and is not able to perform these functions. In these instances, the dead battery needs to be jump started or recharged from an auxiliary source of electrical power.

In certain motor vehicles, it is, however, difficult to find or access the dead battery. Since batteries today require less frequent maintenance, batteries are often placed at an inaccessible location or at a location that is accessible only after multiple components are first removed. As a result, the process of jump starting or recharging the battery can be a time-consuming and frustrating task.

Even when the battery has been located, jump starting or recharging the battery is not easy for many individuals. Booster or jumper cables, which deliver current from the auxiliary power source to the dead battery, must be connected at specific positions with respect to the dead battery. An incorrect connection can damage the battery. Moreover, even when the jumper cables are positioned correctly, sparking can cause damage to the battery and to other engine components.

Thus, it would be desirable to provide an assembly that may be fixedly mounted at any of various accessible locations on a motor vehicle for facilitating easy jump starting or recharging of an electrical storage battery.

SUMMARY OF THE INVENTION

According to one aspect of the invention, a battery hookup assembly is provided for transmitting current from an auxiliary power source to a battery of a motor vehicle. The battery hookup assembly includes a housing adapted to be fixedly mounted to a portion of a motor vehicle. First and second terminals are fixedly secured to the housing for selectively receiving current from the auxiliary power source. At least one cable extends between the first and second terminals and the battery for transmitting current received from the auxiliary power source to the battery.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
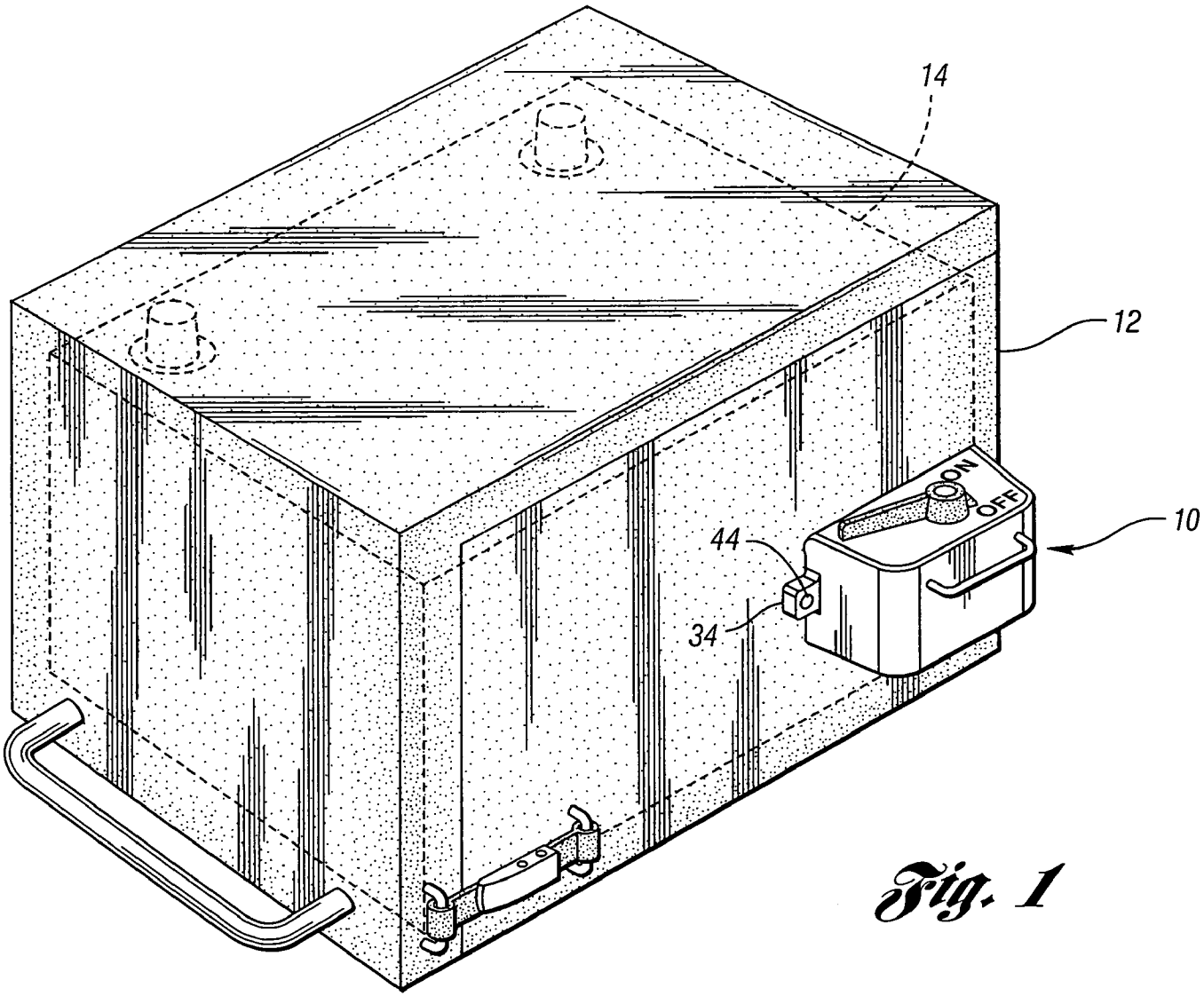
FIG. 1 is a perspective view of a battery compartment and a battery hookup assembly according to the invention fixedly mounted thereto.

Referring to FIG. 1, a battery hookup assembly, generally shown at 10, is fixedly mounted to a motor vehicle component 12. In the present embodiment, the motor vehicle component 12 is a battery compartment. The battery compartment 12 houses an electrical storage battery 14, which is well-known to those of ordinary skill in the art. Although the battery hookup assembly 10 is shown and described as being fixedly mounted to the battery compartment 12, it is appreciated that the battery hookup assembly 10 may be fixedly mounted to any of numerous motor vehicle components and surfaces including, but not limited to, a chassis, a front bumper, a rear bumper, and an underside of a hood or trunk.

Figure 2:
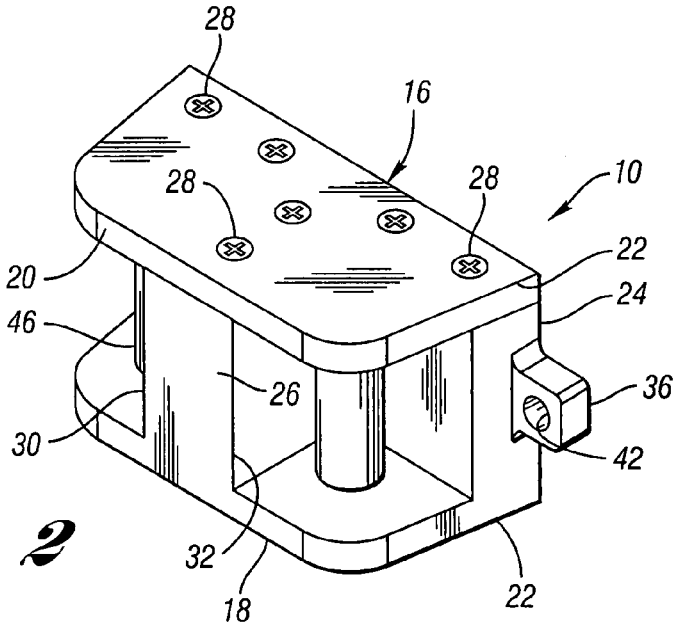
FIG. 2 is a perspective view of the battery hookup assembly.

Referring to FIG. 2, the battery hookup assembly 10 includes a housing, generally indicated at 16, having spaced apart first 18 and second 20 outer members each having a distal end 22. A connecting wall 24 is fixedly secured to and extends between the distal ends 22 of the first 18 and second 20 outer members. A central member 26 is fixedly secured to and extends between the first 18 and second 20 outer members. The central member 26 abuts a portion of the connecting wall 24 and is generally perpendicular thereto. A plurality of fasteners 28 is utilized to fixedly secured the second outer member 20 to the connecting wall 24 and to the central member 26. It is, however, contemplated that the housing 16 may be integrally formed, thereby eliminating the need for the plurality of fasteners 28.

The housing 16 further includes first 30 and second 32 recessed portions separated from one another by the central member 26. More specifically, each of the first 30 and second 32 recessed portions is defined by a portion of each of the first 18 and second 20 outer members, a portion of the connecting wall 24, and the central member 26. It is appreciated that the size of the first 30 and second 32 recessed portions may vary, and further, that such variation in size is dependent upon the shape and configuration of the first 18 and second 20 outer members, the connecting wall 24, and the central member 26.

Figure 3:
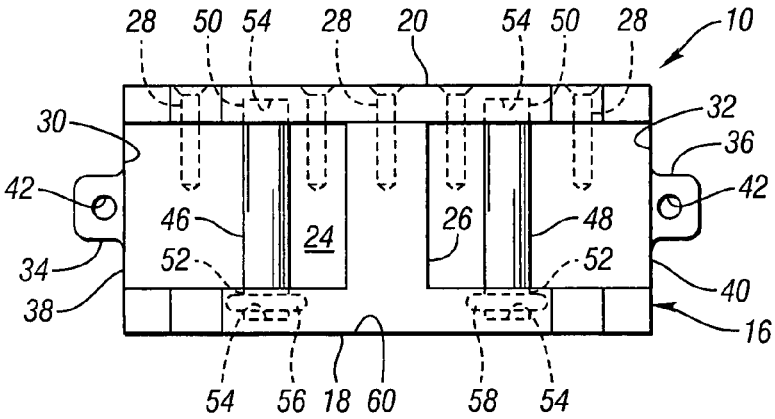
FIG. 3 is a front view of the battery hookup assembly.

Referring to FIG. 3, a pair of mounting tabs 34, 36 extends out from respective ends 38, 40 of the back wall 24. Each of the mounting tabs 34, 36 includes an aperture 42 for receiving a fastener 44 in order to fixedly mount the battery hookup assembly 10 to the motor vehicle component 12, as shown in FIGS. 1 and 5.

Referring now to FIGS. 2 and 3, the battery hookup assembly 10 also includes first 46 and second 48 terminals disposed within the respective first 30 and second 32 recessed portions. Each of the first 46 and second 48 terminals includes terminal ends 50, 52, shown in FIG. 3, that are received within receiving holes 54 formed in the first 18 and second 20 outer members. In a preferred embodiment, the first 46 and second 48 terminals are generally cylindrical posts each extending between the first 18 and second 20 outer members. It is, however, appreciated that the exact shape and orientation of the first 46 and second 48 terminals may vary. The first terminal 46 is a positive terminal and the second terminal 48 is a negative terminal. Preferably, the first 46 and second 48 terminals are color-coded or labeled so that a user is able to distinguish the positive terminal from the negative terminal.

Figure 4:
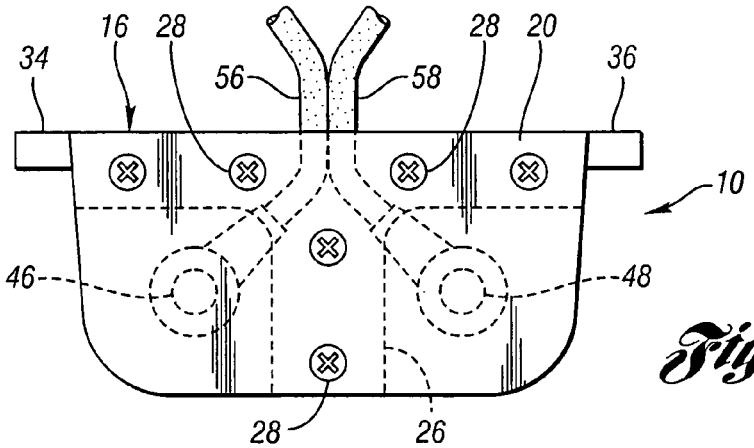
FIG. 4 is a top view of the battery hookup assembly.

Referring to FIGS. 3 and 4, the battery hookup assembly 10 further includes first 56 and second 58 cables coupled to the respective first 46 and second 48 terminals. Each of the first 56 and second 58 cables extends out from the respective first 46 and second 48 terminals and into an interior 60 of the housing 16. The first 56 and second 58 cables extend through an aperture (not shown) in the connecting wall 24 for coupling to the electrical storage battery 14.

Figure 5:
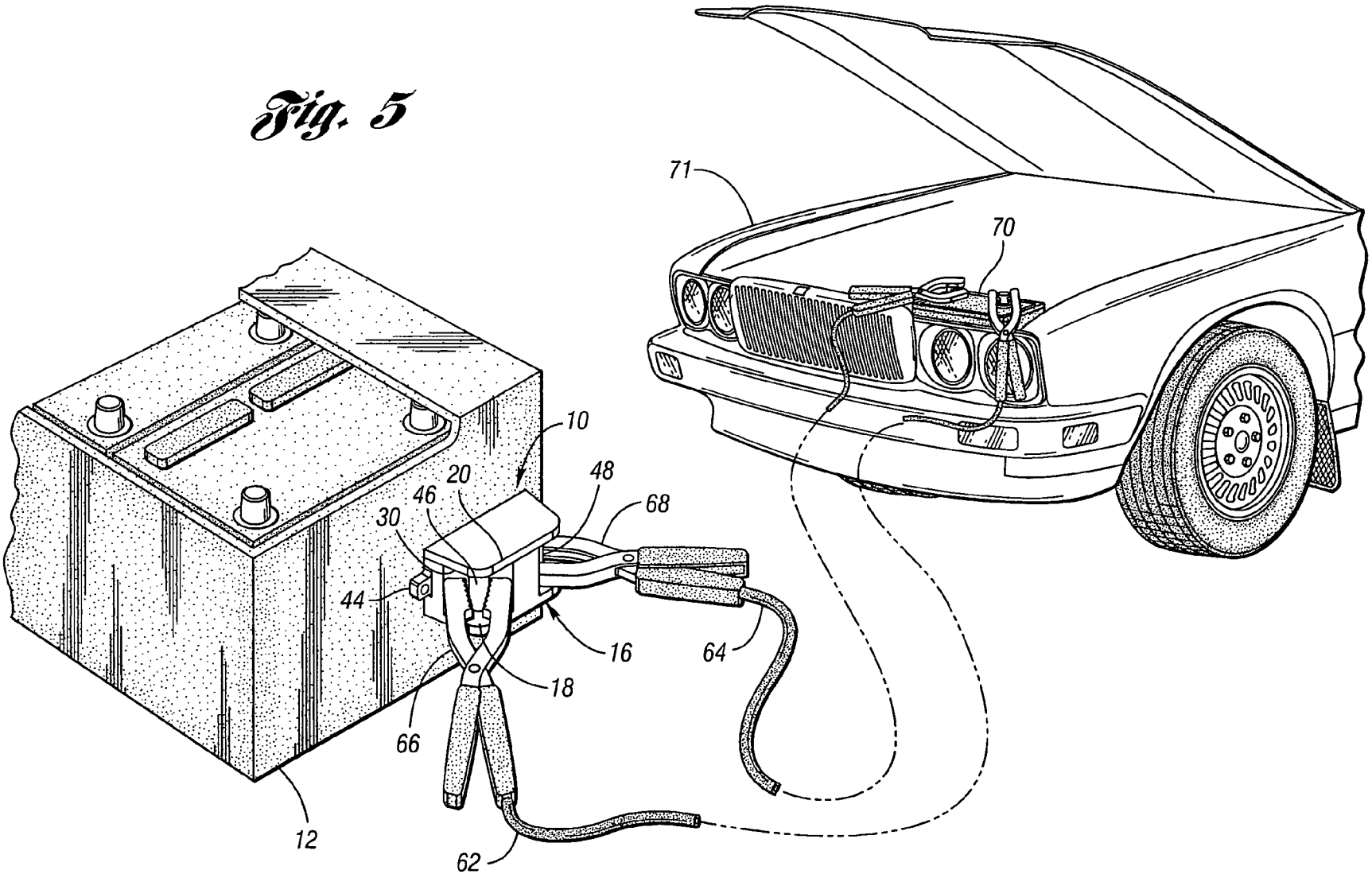
FIG. 5 is a perspective view of the battery compartment including jumper cables connected to the battery hookup assembly.

Referring to FIG. 5, booster or jumper cables 62, 64 are utilized to jump start the storage battery 14 when the storage battery 14 is dead, that is, when the storage battery 14 is weak or discharged. Each of the jumper cables 62, 64 includes a clamp 66, 68 that is selectively attached to the respective first 46 and second 48 terminals. One of the jumper cables 62 extends from a positive terminal of an auxiliary power source 70, such as a charged battery of another motor vehicle 71, to the positive first terminal 46 of the battery hookup assembly 10. The other jumper cable 64 extends from a negative terminal of the auxiliary power source 70 to the negative second terminal 48 of the battery hookup assembly 10. The jumper cables 62, 64 transmit current from the auxiliary power source 70 to the battery hookup assembly 10. The current is subsequently delivered from the battery hookup assembly 10 to the storage battery 14 via the first 56 and second 58 cables.

In certain motor vehicles, the storage battery 14 is placed at an inaccessible location or a location that is accessible only after the user removes one or more overlying parts. Thus, in order to jump start or recharge the storage battery 14, the user must first locate the storage battery 14 and, if necessary, remove any parts obstructing the storage battery 14. The battery hookup assembly 10 eliminates the need for direct access to the storage battery 14. Once the battery hookup assembly 10 is operably connected to the storage battery 14 via the first 56 and second 58 cables, the battery hookup assembly 10 can be mounted to any of numerous motor vehicle components 12. Preferably, the battery hookup assembly 10 is mounted at a location that provides easy external access to the user. As an added benefit, conducting the jump starting or recharging operation away from the storage battery 14 itself reduces the possibility of damaging the storage battery 14 or other engine components.

Figure 6:
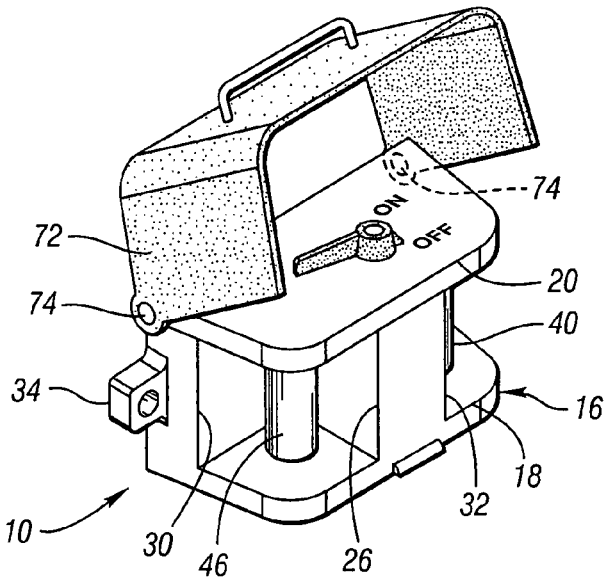
FIG. 6 is a perspective view of the battery hookup assembly including a cover.

Referring to FIG. 6, a cover 72 is pivotally hinged to the housing 16 for providing selective access to the first 46 and second 48 terminals. The cover 72 pivots about a pair of hinges 74 for movement between an open position, shown in FIG. 6, and a closed position, shown in FIG. 1. More specifically, when the cover 72 is in the open position, the first 46 and second 48 terminals are free to receive the clamps 66, 68 of the jumper cables 62, 64. In the closed position, the cover 72 shields the first 46 and second 48 terminals from dirt, mud, moisture, and the like. Typically, the cover 72 is spring-biased towards the closed position.

Although the cover 72 has been shown and described above as being pivotally hinged to the housing 16, it is appreciated that various alternative covers, such as a plastic snap-on cover, may be utilized to cover the first 46 and second 48 terminals.

Figure 7:
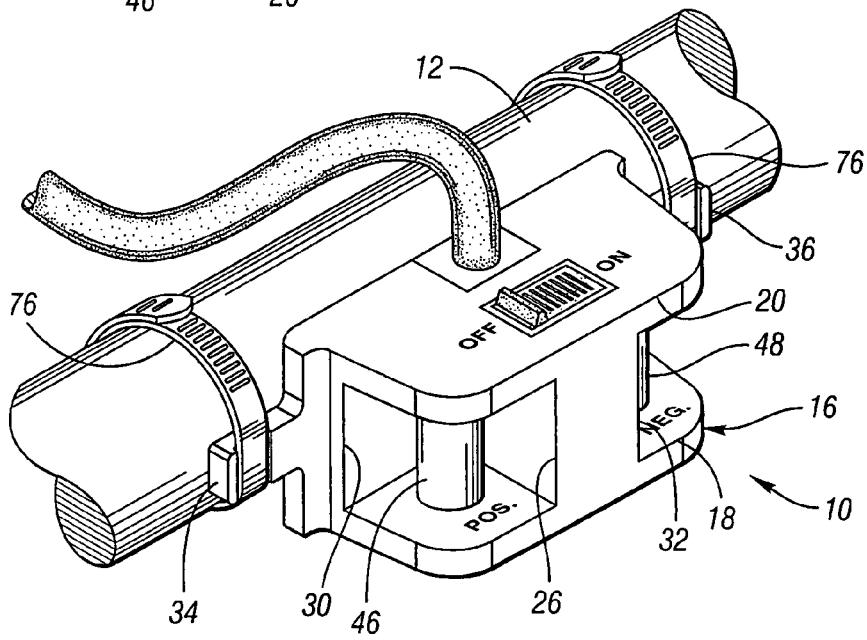
FIG. 7 is a perspective view of the battery hookup assembly including a plurality of ties utilized for mounting the battery hookup assembly to a motor vehicle component.

Referring to FIG. 7, a plurality of ties 76 may be utilized to couple the battery hookup assembly 10 to the motor vehicle component 12. The motor vehicle component 12 in FIG. 7 is a motorcycle frame. Each of the plurality of ties 76, which is preferably formed from plastic, wraps around one of the pair of mounting tabs 34, 36 of the battery hookup assembly 10 and a portion of the motorcycle frame 12.

Figure 8:
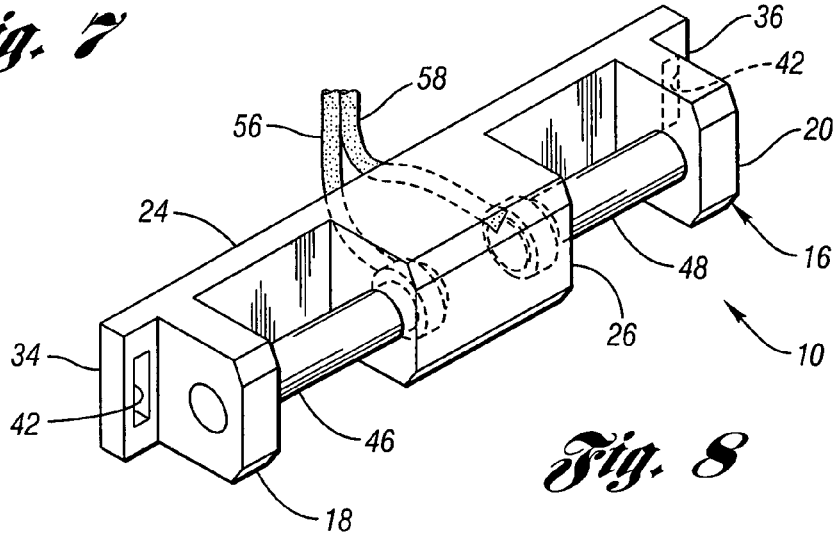
FIG. 8 is a perspective view of another configuration of the battery hookup assembly.

Referring to FIGS. 8 through 11, various configurations of the battery hookup assembly 10 are shown for exemplary purposes and are not intended to be limiting in any way. Referring specifically to FIG. 8, the first terminal 46 is fixedly secured between the first outer member 18 and the central member 26, and the second terminal 48 is fixedly secured between the second outer member 20 and the central member 26. As a result, the first 46 and second 48 terminals are disposed horizontally (when seen in the orientation presented in FIG. 8) rather than vertically (when see in the orientation presented in FIGS. 1 through 7).

Figure 9:
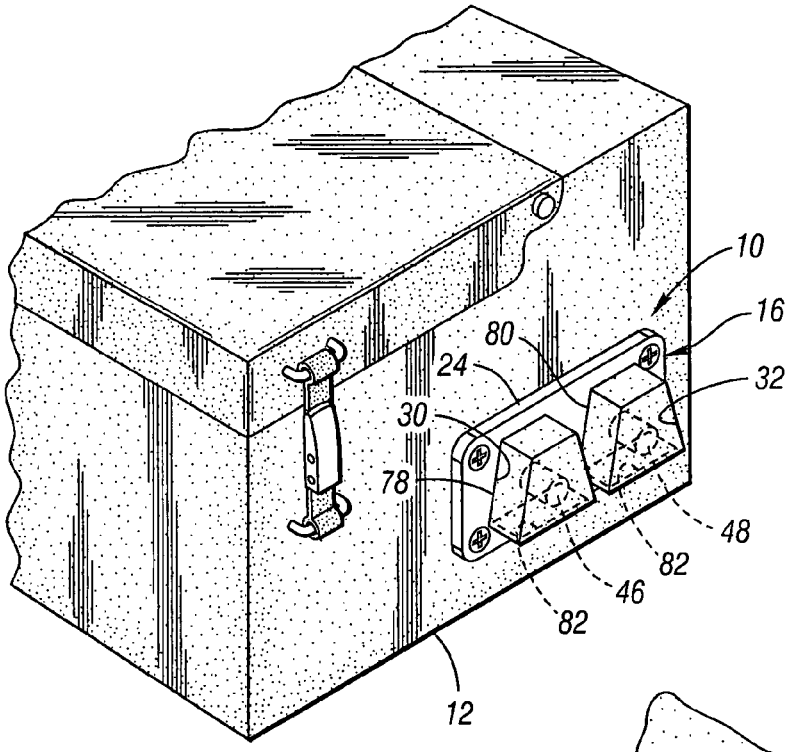
FIG. 9 is a perspective view of the battery compartment with still another configuration of the battery hookup assembly fixedly mounted thereto.

Referring to FIG. 9, the battery hookup assembly 10 includes a pair of spaced apart terminal compartments 78, 80 each partially defined by the connecting wall 24. The terminal compartments 78, 80 include the first 30 and second 32 recessed portion. The first terminal 46 is disposed within the first recessed portion 32 of one of the terminal compartments 78, and the second terminal 48 is disposed within the second recessed portion 32 of the other terminal compartment 80. Each of the terminal compartments 78, 80 includes a bottom opening 82 through which access to the first 46 and second 48 terminals is gained.

Figure 10:
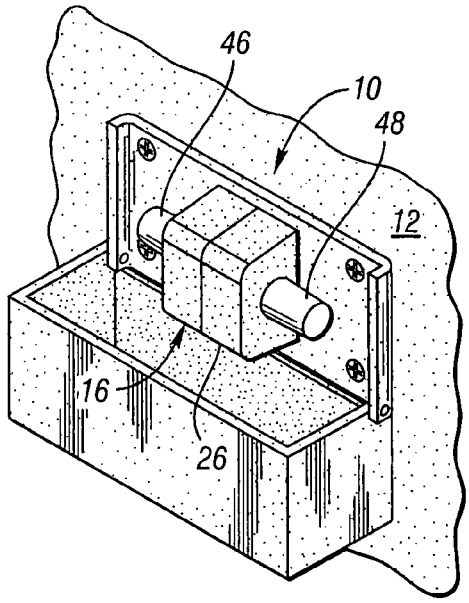
FIG. 10 is a perspective view of yet another configuration of the battery hookup assembly including first and second terminals fixedly mounted to the cover.

Referring to FIG. 10, the first 46 and second 48 terminals are fixedly secured to the central member 26 and extend out from each end 84 thereof.

Figure 11:
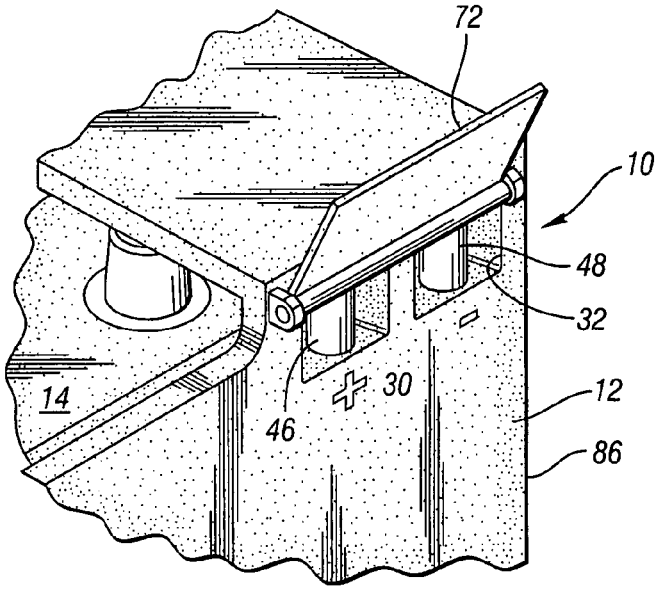
FIG. 11 is a fragmentary, perspective view of the battery compartment having an integrally formed battery hookup assembly.

Referring to FIG. 11, the battery hookup assembly 10 is integrally formed with the battery compartment 12. More specifically, the first 30 and second 32 recessed portions are openings formed along one of the sides 86 of the battery compartment 12. The first 46 and second 48 terminals are disposed within the respective first 30 and second 32 recessed portions. The side 88 of the battery compartment 12 is labeled to indicate the positive first terminal 52 and the negative second terminal 54. The cover 72 is pivotally hinged to the side 86 of the battery compartment 12 to selectively cover the positive first 46 and negative second 48 terminals.

The invention has been described in an illustrative manner. It is to be understood that the terminology, which has been used, is intended to be in the nature of words of description rather than of limitation. Many modifications and variations of the invention are possible in light of the above teachings. Therefore, within the scope of the appended claims, the invention may be practiced other than as specifically described.

Figure 12:
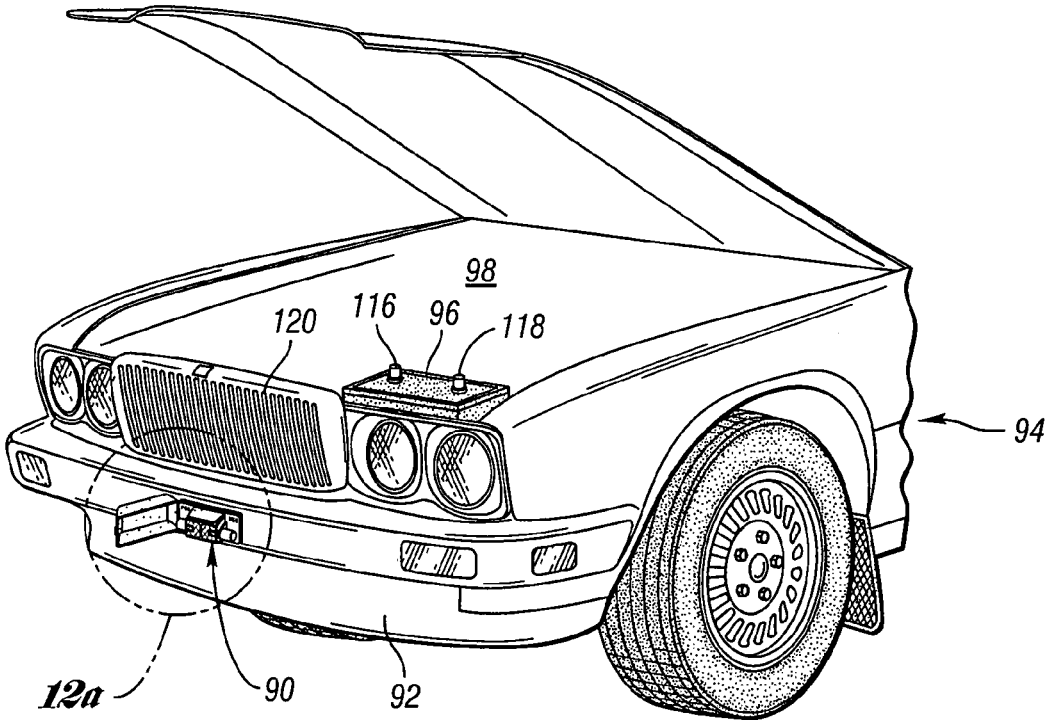
FIG. 12 is a perspective view of an engine compartment of a contemporary vehicle and a battery hookup assembly mounted on a front bumper of the vehicle.

FIG. 12 shows an embodiment of the invention wherein the battery hookup assembly, seen at 90, is fixed to the front bumper 92 of a contemporary vehicle 94. A vehicle storage battery 96 is located in a conventional fashion in engine compartment 98 of the vehicle 94.

Figure 12A:
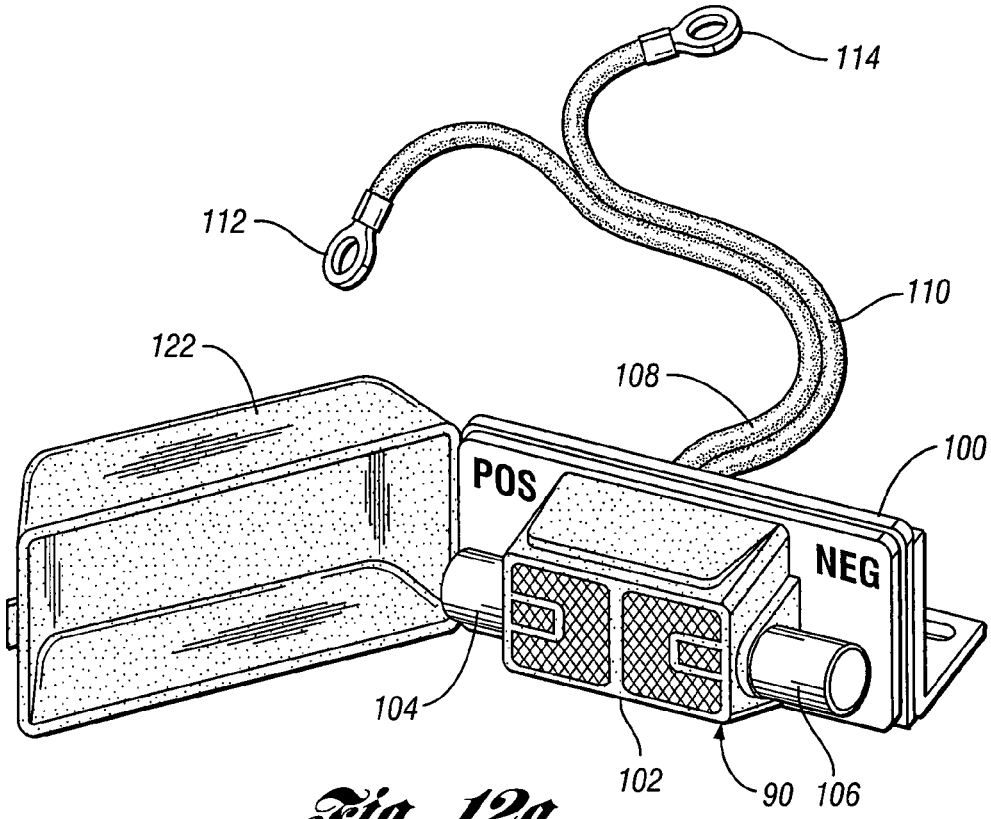
FIG. 12*a* is an enlarged view of the battery hookup assembly seen in FIG. 12.

The battery hookup assembly is seen in greater detail in the enlarged view of FIG. 12*a*. It comprises a mounting plate 100 that is secured by suitable fasteners to front bumper assembly 92 of the vehicle 94. A central portion 102 of the battery hookup assembly 90 is fixed to the mounting plate 100. Positive and negative terminals 104 and 106, respectively, are supported by the central portion 102 of the battery hookup assembly 90. Power cables 108 and 110 are electrically connected, respectively, to the terminals 104 and 106 through conduit elements, not shown, within the central portion 102. The ends of the cables 108 and 110 carry connectors 112 and 114, respectively, which are adapted to be received over vehicle battery terminals 116 and 118, respectively. As seen in FIG. 12, the cables 108 and 110 are trained through the engine compartment area so that they are hidden by the bumper assembly and by the vehicle grill 120. A cap, or cover, 122, which may be hinged on the plate 100, is adapted to cover the terminals 104 and 106 and the central portion 102 when the battery hookup assembly is not in use.

Figure 13:
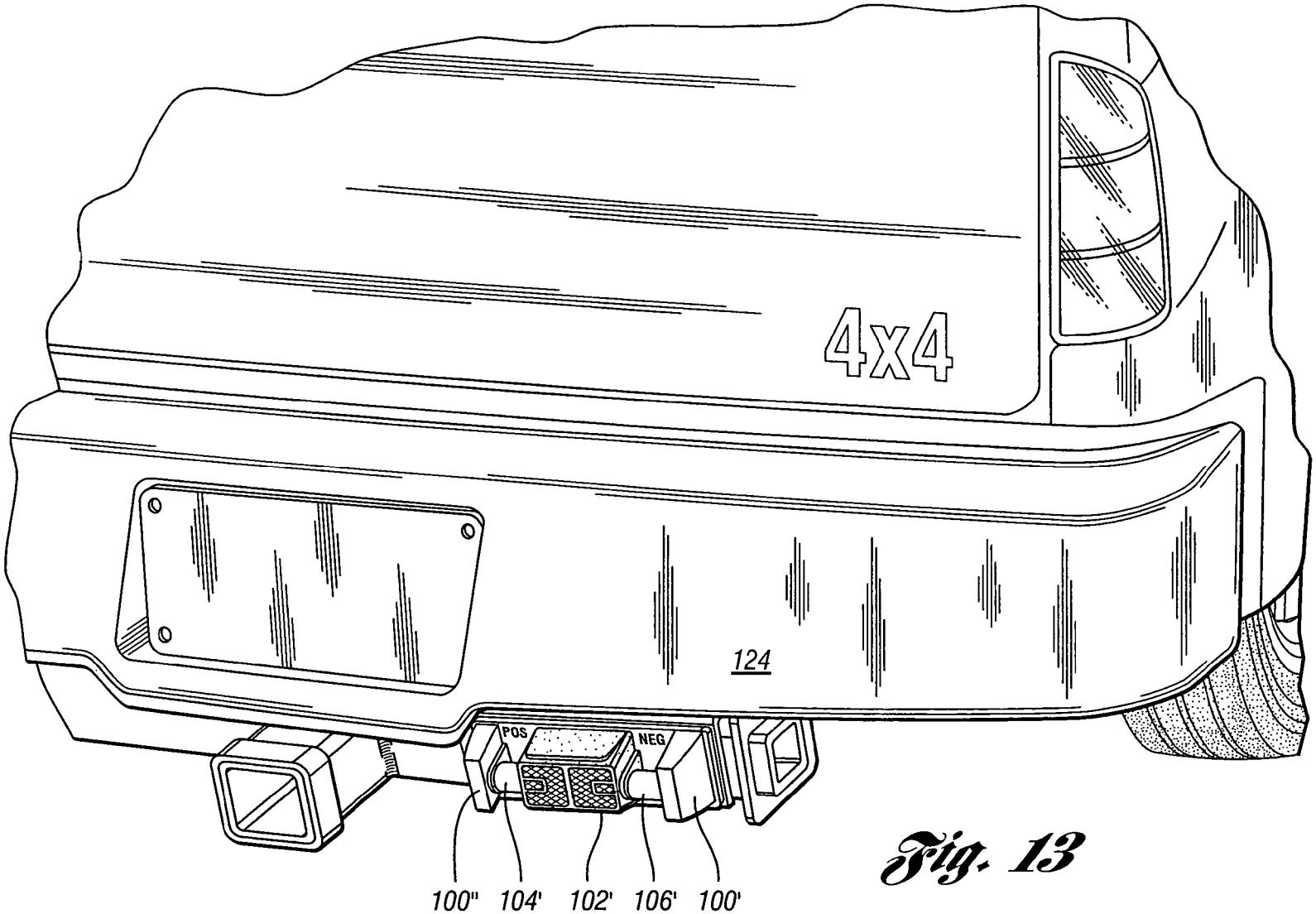
FIG. 13 is a view of a battery hookup assembly that is mounted on the rear bumper of a contemporary automotive vehicle.

FIG. 13 is a view showing the battery hookup assembly 12 of FIG. 12 mounted on the rear bumper assembly 124 for an automotive vehicle. A cover or cap such as that shown at 122 in FIG. 12*a*, can be applied to the battery hookup assembly seen in FIG. 13, although a cover or cap is not illustrated in FIG. 13.

In FIG. 13, reference numerals with prime notations are added. Those numerals correspond to numerals used in describing corresponding elements of the battery hookup assembly of FIG. 12*a*. The support plate 100 of FIG. 12*a* has a function that corresponds to the function of mounting elements 100' and 100" in FIG. 13.

What is claimed:

1. A battery hookup assembly for transmitting current from a power source to a battery of a motor vehicle, said battery hookup assembly comprising:

a housing adapted to be fixedly mounted to a portion of the motor vehicle;

first and second terminals fixedly secured to said housing for distributing current between the power source and the battery; and cables extending between said first and second terminals and the battery for transmitting current between said first and second terminals and the battery.

2. A battery hookup assembly as set forth in claim 1 wherein said housing includes first and second outer members and a connecting wall extending therebetween.

3. A battery hookup assembly as set forth in claim 2 wherein said housing includes at least one recessed portion partially defined by said first and second outer members and said connecting wall for receiving said first and second terminals.

4. A battery hookup assembly as set forth in claim 3 wherein said housing includes a central member disposed between said first and second outer members and extending out perpendicularly from said connecting wall.

5. A battery hookup assembly as set forth in claim 4 wherein each of said first and second terminals is a cylindrical post.

6. A battery hookup assembly as set forth in claim 5 wherein said first terminal is a positive terminal.

7. A battery hookup assembly as set forth in claim 6 wherein said second terminal is a negative terminal.

8. A battery hookup assembly as set forth in claim 7 including a cover for selectively covering said first and second terminals.

9. A battery hookup assembly as set forth in claim 8 wherein each of said first and second terminals includes one end fixedly secured to said first outer member and an opposing end fixedly secured to said second outer member.

10. A battery hookup assembly as set forth in claim 8 wherein said first terminal includes one end fixedly secured to said first outer member and an opposing end fixedly secured to said central member.

11. A battery hookup assembly as set forth in claim 10 wherein said second terminal includes one end fixedly secured to said second outer member and an opposing end fixedly secured to said central member.

12. A battery hookup assembly for transmitting current from a power source to an electrical storage battery of a motor vehicle, said battery hookup assembly comprising:

a housing adapted to be fixedly mounted to a portion of the motor vehicle, said housing having a central member partially defining first and second recessed portions;

first and second terminals fixedly secured with said respective first and second recessed portions for distributing current between the power source and the battery; and cables extending between said first and second terminals and the battery for distributing current between said first and second terminals and the battery.

13. A battery hookup assembly as set forth in claim 12 wherein said housing includes a cover selectively covering said first and second terminals.

14. A battery hookup assembly as set forth in claim 13 wherein each of said first and second terminals is a cylindrical post.

15. A battery hookup assembly as set forth in claim 14 wherein said first terminal is a positive terminal.

16. A battery hookup assembly as set forth in claim 15 wherein said second terminal is a negative terminal.

17. The battery hookup assembly set forth in claim 1 wherein the motor vehicle portion is a vehicle bumper assembly;

the housing and the first and second terminals being secured to the bumper assembly;

the cables extending between the battery and the terminals.

18. The battery hookup assembly set forth in claim 12 wherein the motor vehicle portion is a vehicle bumper assembly;

the housing and the first and second terminals being secured to the bumper assembly;

the cables extending between the battery and the terminals.

* * * * *